US008739894B2

(12) United States Patent
Schlauch et al.

(10) Patent No.: US 8,739,894 B2
(45) Date of Patent: Jun. 3, 2014

(54) HANDHELD WORK APPARATUS

(75) Inventors: Patrick Schlauch, Esslingen (DE); Roland Adam, Besigheim (DE); Heiko Stöcker, Esslingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 384 days.

(21) Appl. No.: 13/307,657

(22) Filed: Nov. 30, 2011

(65) Prior Publication Data

US 2012/0138326 A1 Jun. 7, 2012

(30) Foreign Application Priority Data

Dec. 1, 2010 (DE) ..... 10 2010 053 086

(51) Int. Cl.
*B25F 5/00* (2006.01)
*B23D 57/02* (2006.01)

(52) U.S. Cl.
USPC ..... 173/170; 16/110.1; 30/122; 30/166.3; 30/382; 74/502.2; 123/179.18; 123/398; 261/52

(58) Field of Classification Search
USPC ..... 173/170, 171; 30/122, 166.3, 210, 276, 30/381, 382, 383; 123/179.16, 179.18, 123/398; 227/8, 131; 16/110.1, 430, 445, 16/900; 261/52, 64.6, 65; 74/489, 501.6, 74/502.2, 527
See application file for complete search history.

(56) References Cited

U.S. PATENT DOCUMENTS 4,079,708 A 3/1978 Wieland et al.
4,946,087 A * 8/1990 Wingert ..... 227/131
5,215,049 A 6/1993 Wolf
5,239,891 A * 8/1993 Stocker ..... 74/513
5,517,967 A * 5/1996 Nakayama ..... 123/398
5,927,241 A * 7/1999 Dahlberg et al. ..... 123/179.5
6,021,757 A * 2/2000 Nagashima ..... 123/400
6,108,867 A 8/2000 Nagashima
6,871,623 B2 * 3/2005 Ohsawa et al. ..... 123/179.18
7,287,331 B2 * 10/2007 Sasaki et al. ..... 30/519
7,337,757 B2 * 3/2008 Schmidt et al. ..... 123/179.16
7,484,431 B2 * 2/2009 Muller et al. ..... 74/502.2
8,051,743 B2 * 11/2011 Kullberg et al. ..... 74/502.2
8,156,656 B2 * 4/2012 Tate et al. ..... 30/392
8,490,289 B2 * 7/2013 Nystrom et al. ..... 30/166.3

FOREIGN PATENT DOCUMENTS

DE 36 08 941 A1 9/1987

OTHER PUBLICATIONS

Search report of the European Patent Office dated Mar. 30, 2012 issued in the parallel European application.

* cited by examiner

*Primary Examiner* — Scott A. Smith
(74) *Attorney, Agent, or Firm* — Walter Ottesen P.A.

(57) ABSTRACT

The invention relates to a handheld work apparatus having a handle. A throttle trigger and a throttle trigger lock are arranged on the handle. An operating-mode selector having an off position, an operating position and a starting position is provided. The selector, trigger lock and the trigger are pivotally mounted. A first latching element is provided on the selector and a second latching element is provided on the trigger element, which coact in the starting position of the selector and the starting position of the trigger and hold the trigger in its starting position. To ensure that the starting position of the selector can only be engaged when the trigger is actuated, the second latching element lies outside of the pivot path of the first latching element in the non-actuated position of the trigger.

14 Claims, 4 Drawing Sheets

HANDHELD WORK APPARATUS

CROSS REFERENCE TO RELATED APPLICATION

This application claims priority of German patent application no. 10 2010 053 086.7, filed Dec. 1, 2010, the entire content of which is incorporated herein by reference.

BACKGROUND OF THE INVENTION

U.S. Pat. No. 5,215,049 discloses a handheld work apparatus having a top handle, in particular a top-handle chain saw. An operating-mode selector, a throttle trigger and a throttle trigger lock, are pivotably mounted on the handle. The operating-mode selector and the throttle trigger coact when the operating-mode selector and the throttle trigger are in the starting position. The latch elements of the operating-mode selector and throttle trigger, which define the starting position, are arranged in such a manner that the operating-mode selector can be pushed into the starting position when the throttle trigger is not actuated. The throttle trigger is pivoted in the process. This pivot movement is blocked when the throttle trigger lock is not actuated. If, however, the throttle trigger lock is pressed, then the starting position can be engaged without the throttle trigger being actuated.

It is desirable that an engaging of the starting position of the operating-mode selector is not possible when the throttle trigger is not pressed by the operator.

SUMMARY OF THE INVENTION

It is an object of the invention to provide a handheld work apparatus which allows for the engaging of the starting position only when the throttle trigger is pressed.

The handheld work apparatus of the invention includes: a housing; a handle configured to be arranged above the housing in a typical storage position of the work apparatus and the handle being configured as a carrying handle; a throttle trigger having a starting position and a non-actuated position; the throttle trigger being arranged on the handle; a throttle trigger lock arranged on the handle; an operating-mode selector having an off position, an operating position and at least one starting position; the throttle trigger, the throttle trigger lock and the operating-mode selector being pivotally mounted; a first latch element defining a first pivot path and being arranged on the operating-mode selector; a second latch element arranged on the throttle trigger; the first and second latch elements being configured to coact in the starting position of the operating-mode selector and the starting position of the throttle trigger so as to hold the throttle trigger in the starting position thereof; and, the second latch element being configured to lie outside of the first pivot path of the first latch element when the throttle trigger is in the non-actuated position.

Because the second latch element is outside of the pivot path of the first latch element at the operating-mode selector when the throttle trigger is in a non-actuated position, the operating-mode selector can be freely pivoted without function when the throttle trigger is not actuated. No latching between the operating-mode selector and the throttle trigger is achieved. The operating-mode selector is therefore returned back to the operating position when released from the starting position on account of its spring loading. The engaging of the starting position without previously actuating the throttle trigger is not possible as a result.

Advantageously, when the throttle trigger is moved out of the non-actuated position into the full throttle position, the second latch element is pivoted as a result of the pivot path of the first latch element. In the full throttle position, the second latch element advantageously lies outside of the pivot path of the first latch element. The position outside of the pivot path includes a position, relative to the pivot axis of the throttle trigger, radially outside of the pivot path as well as a position radially within the pivot path. In particular, the second latch element is radially outside the pivot path of the first latch element in the non-actuated position of the throttle trigger and radially within the pivot path of the first latch element in the full throttle position and thus has a larger distance to the pivot axis of the throttle trigger than the first latch element in the non-actuated position and a smaller distance to the pivot axis of the throttle trigger than the first latch element in the full throttle position. The operating-mode selector can, thus, only be moved when the throttle trigger has been moved so far that the second latch element lies outside of the pivot path of the first latch element.

In order to ensure a latching in the starting position, it is provided that the first latch element lies in the pivot path of the second latch element when the operating-mode selector is in the starting position. Thus, the second latch element comes to rest at the first latch element and is held in the starting position after the release of the throttle trigger.

Advantageously, the latch elements extend in the direction of the pivot axis of the throttle trigger. During pivoting of the operating-mode selector from the starting position into the off-position, it is provided that the latching of the latch elements is released, with at least one of the latch elements being deflected away from the other latch element in the direction of the pivot axis of the throttle trigger. As a result of the deflection in the direction of the pivot axis for the release of the latching, it can be ensured that the throttle trigger is not further actuated during the pivoting of the operating-mode selector from the starting position into the off position. It can, however, also be provided that additionally or alternatively at least one of the latch elements is elastically deformed when the latching is released. Even in the case of elastic deformation of at least one of the latch elements a further actuating of the throttle trigger can be avoided while releasing the latching. Advantageously, at least one of the latch elements has a section which extends in inclined manner toward the pivot axis of the throttle trigger, said section sliding on the other latch element when the operating-mode selector is pivoted from the starting position into the off position. The section extending in an inclined manner can in this case be straight, as for example a chamfer, or arch-shaped as for example in a radius. In particular, one of the latch elements is a lug. A lug can be produced simply and with low tolerances and can be easily produced with the operating-mode selector during the production of the operating-mode selector from plastic. The checking of whether the required tolerances were adhered to can be done easily in the case of a lug because a lug can be easily measured. The section extending in an inclined manner toward the pivot axis of the throttle trigger is advantageously arranged at the free end of the lug. A chamfer or a radius can be very easily formed at the free end of the lug, so that a simple configuration results. A radius is seen as especially advantageous because sharp edges can, thereby, be avoided on the lug.

Expediently one of the latch elements is an arch-shaped wall section which forms a receiver for the other latch element. Because of the arch-shaped configuration a secure latching is achieved. The lug can be mounted behind the arch-shaped section and thus be securely held. The wall section is, in particular, arranged on an arm of the throttle trigger. The arch-shaped configuration of the wall section at the same time prevents engaging of the starting position of the operating-mode selector without sufficient actuation of the throttle trigger. In the latched position the lug advantageously rests against the concave side of the wall section. If the operating-mode selector is pressed in the off position then the lug exerts a force on the wall section in the radial direction to the pivot axis, which force is converted to an axial force by the chamfer or the radius. For engaging the starting position, the operating-mode selector must rest against the convex side of the wall section and press against the convex wall section. Because of the arch-shaped configuration of the wall section, the throttle trigger is pivoted by the force exerted by the lug and an engaging of the starting position is not possible.

The operating-mode selector, in particular, has a receptacle for a contact pin. The contact pin can coact with the contact spring of an ignition unit and in the off position of the operating-mode selector can short circuit the drive motor configured as a combustion engine. At the same time a desired spring-loading of the operating-mode selector can be achieved via the contact spring. In particular, the pivot axes of the throttle trigger, throttle trigger lock and operating-mode selector lie parallel to each other and have a distance between each other.

Advantageously, an actuating element for actuating a drive motor of the work apparatus engages at the throttle trigger. The distance of the contact point of the actuating element to the second latch element is, advantageously, up to about a third of the distance of the contact point of the actuating element to the pivot axis of the throttle trigger. As a result of the comparatively small distance of the contact point to the latch element small tolerances are achieved for the starting position which is set by the actuating element. An exact position, for example of a choke element in the starting position can be achieved in a simple manner.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
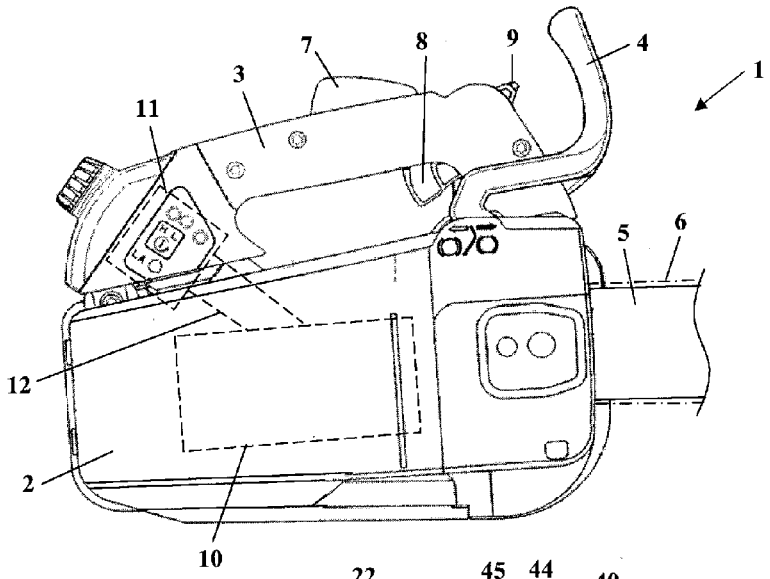
FIG. 1 shows a schematic side view of a chain saw.

FIG. 1 shows a chain saw 1 as an exemplary embodiment of a handheld work apparatus. The chain saw 1 is shown in a typical storage position in FIG. 1. The chain saw 1 has a housing 2 which is positioned on the floor or on a storage surface in the storage position. A guide bar 5 extends forward on the housing 2, a saw chain 6 being driven about the periphery of the guide bar 5. The saw chain 6 is driven by a drive motor 10 arranged in the housing 2. The drive motor 10 is configured as a combustion engine. The drive motor 10 is supplied with fuel and combustion air via a carburetor 11 and an intake channel 12. It can also be provided that the fuel is supplied directly to the drive motor 10. The carburetor 11 is arranged in a rear region of a top handle 3 with the rear region facing away from the guide bar 5. The top handle 3 is arranged on the upward projecting side of the housing 2 in the storage position and is fixed on the housing 2 via anti-vibration elements which are not shown. The top handle 3 serves as a carrying handle. A throttle trigger lock 7, a throttle trigger 8 and an operating-mode selector 9 are pivotably mounted on the top handle 3. A hand guard 4, which serves to release a chain brake for the saw chain 6, is arranged adjacent to the front end of the top handle 3.

Figure 2:
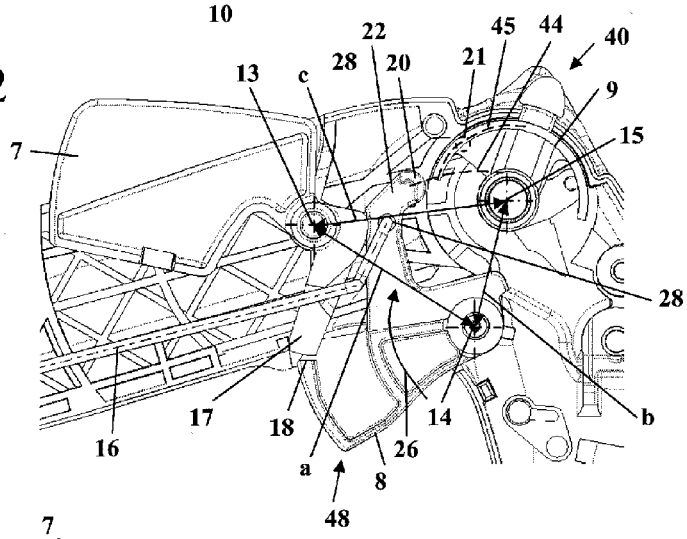
FIG. 2 shows a cutaway side view of the top handle of the chain saw of FIG. 1 with the top handle half shell removed.

As FIG. 2 shows, the throttle trigger lock 7 is pivotably mounted about a pivot axis 13. The throttle trigger lock 7 has a blocking edge 17 which, in the non-actuated position of the throttle trigger lock 7, prevents an actuation of the throttle trigger 8. For this, the blocking edge 17 lies adjacent to a blocking edge 18 of the throttle trigger 8. The throttle trigger 8 is pivotably mounted about a pivot axis 14 which is at a distance (a) to the pivot axis 13 of the throttle trigger lock 7. The throttle trigger 8 is pivoted about the pivot axis 14 in the direction of the arrow 26 in order to open the throttle. The throttle trigger 8 has an arm 22 on which a throttle linkage 16 for actuating a throttle element arranged in the carburetor 11 is engaged. The throttle linkage 16 is engaged in an opening 28 of the arm 22. An arch-shaped wall section 20 is arranged on the arm 22 adjacent to its free end. In relation to the surface of the arm 22, the arch-shaped wall section 20 is offset in the direction of the pivot axis 14.

The operating-mode selector 9 is pivotably mounted about a pivot axis 15, which is at a distance (b) to the pivot axis 14 of the throttle trigger 8 and a distance (c) to the pivot axis 13 of the throttle trigger lock 7. The operating-mode selector 9 has a lug 21, shown schematically in FIG. 2. The lug 21 and the wall section 20 form latching elements which coact in the starting position. When the throttle trigger 8 is pivoted, the wall section 20 travels along a pivot path 44 and the lug 21 travels a pivot path 45. FIG. 2 shows the operating-mode selector 9 in the operating position 40. The throttle trigger 8 is arranged in the non-actuated position 48. In this position, the wall section 20 lies outside of the pivot path 45 of the lug 21. The operating-mode selector 9 can be freely moved in this position without the lug 21 being able to come into engagement with the wall section 20. Thus, it is prevented that a latching between the operating-mode selector 9 and the throttle trigger 8 can occur when the throttle trigger 8 is not actuated.

Figure 3:
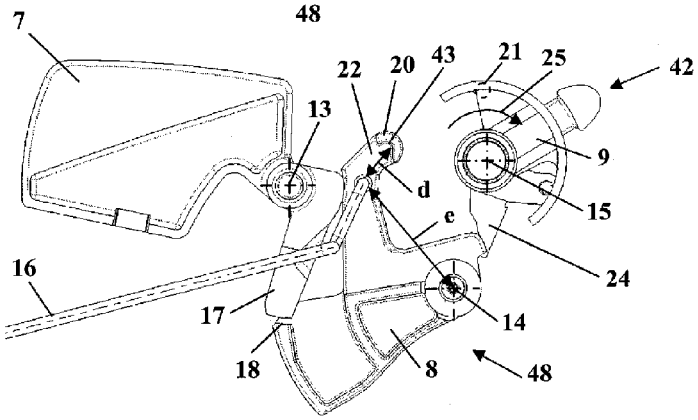
FIG. 3 shows a side view of the throttle trigger lock, throttle trigger and operating-mode selector in the off position.

FIG. 3 shows the throttle trigger 8 in the non-actuated position 48 and the operating-mode selector 9 in the off position 42. In this position, the operating-mode selector 9 has been pivoted in the direction of an arrow 25 in relation to the operating position 40 shown in FIG. 2. The operating-mode selector 9 has an arm 24 which, radially to the pivot axis 15, juts out in a direction toward the throttle trigger 8. In the off position 42, the arm 24 rests against a stop, not shown, of the handle 3. The arm 24 is configured in such a manner that it rests against the stop in every position of the throttle trigger 8, so that a stop for the off position 42 is given irrespective of the position of the throttle trigger 8. As FIG. 3 shows, the arch-shaped wall section 20 forms a receptacle 43 for the lug 21.

Figure 8:
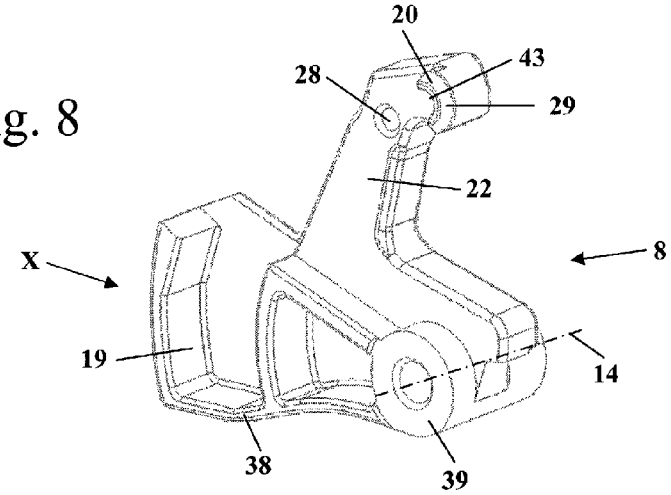
FIG. 8 is a perspective view of the throttle trigger.

The throttle linkage is engaged on the arm 22 of the throttle trigger in an opening 28 (FIG. 8). The opening 28 is at a distance (e) to the pivot axis 14 of the throttle trigger. The opening 28 is at a distance (d) to the wall section 20, which is up to a third of the distance (e) as shown in FIG. 3. As a result of the small distance of the engaging of the throttle linkage 16 to the latching, an exact positioning of the throttle linkage 16 in the starting position is achieved.

Figure 4:
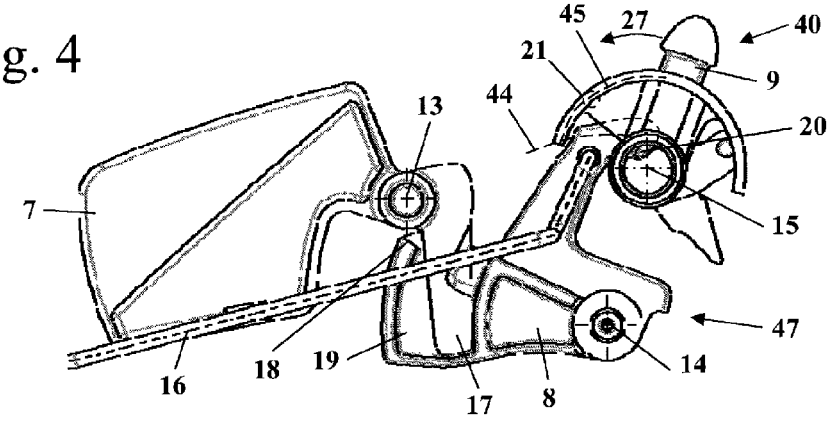
FIG. 4 shows a side view of the trigger of FIG. 3 in the full throttle position of the throttle trigger.
Figure 5:
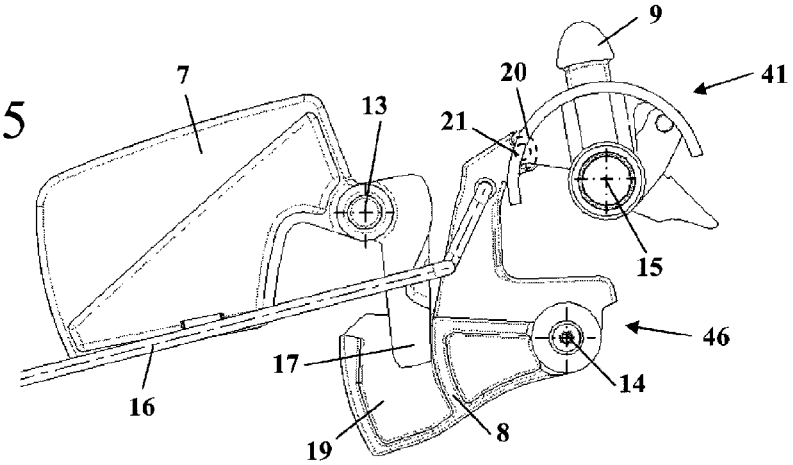
FIG. 5 shows a side view of the trigger of FIG. 3 in the start position.

FIG. 4 shows the throttle trigger 8 in the full throttle position 47. In order to get to the full throttle position 47, the throttle trigger 8 has been pivoted out of the position shown in FIG. 2 in the direction of the arrow 26, that is, clockwise in the drawings. In order to be able to pivot the throttle trigger 8, the throttle trigger lock 7 was first pressed. As a result, the blocking edge 17 moves into a receptacle 19 in the throttle trigger 8. The blocking edge 18 of the throttle trigger 8 can pivot past the blocking edge 17 unimpeded. In order to reach the full throttle position 47 of the throttle trigger 8, the wall section 20 is pivoted through the pivot path 45 of the lug 21. The pivot path 44 of the wall section 20 intersects the pivot path 45 of the lug 21 and, when the throttle is opened, the wall section 20 is moved from the side radially outside of the pivot path 45 in relation to the pivot axis 15 to the side radially inside the pivot path 45. In order to switch from the full throttle position 47 shown in FIG. 4 to the starting position 41 of the operating-mode selector 9, the operating-mode selector 9 is pivoted in the direction of the arrow 27, that is, counterclockwise in FIG. 4. If the throttle trigger 8 is thereafter released, then the wall section 20 engages on the lug 21. This is shown in FIG. 5. The throttle trigger 8 is held in a starting position 46 in which the throttle trigger 8 is partially actuated, that is, partially moved from the non-actuated position towards the full throttle position. When the operating-mode selector 9 is pivoted from the operating position 40 into the starting position 41 the lug 21 is moved into the pivot path 44 of the wall section 20, that is, to where the pivot paths 44 and 45 intersect.

Figure 6:
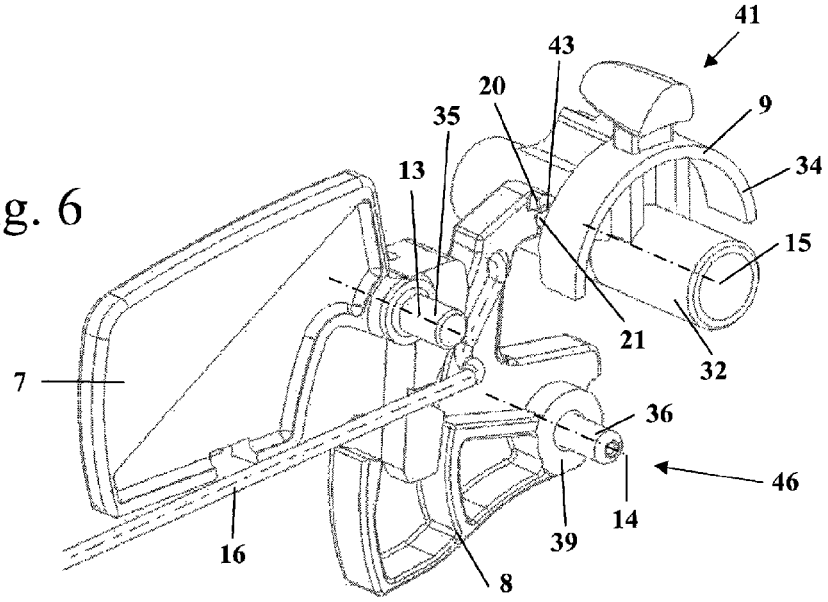
FIG. 6 shows a perspective view of the trigger in the position of FIG. 5.

As FIG. 6 shows, the lug 21 lies in the receptacle 43 when the throttle trigger 8 is in the starting position 46 and the operating-mode selector 9 is in the starting position 41. As FIG. 6 also shows, the throttle trigger lock 7 is pivotably mounted in the top handle 3 with a bearing pin 35. The throttle trigger 8 has a receptacle 39 in which a bearing pin 36 is arranged for the pivotable mounting in the top handle 3. The operating-mode selector 9 has a mounting shaft 32 configured to be hollow with which it is pivotably mounted in the handle 3.

Figure 7:
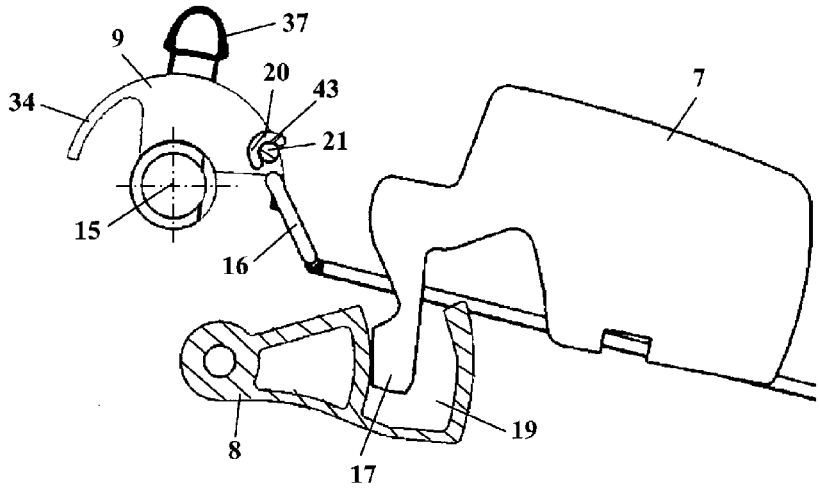
FIG. 7 shows a schematic section through the triggers in the position of FIGS. 5 and 6.

FIG. 7 shows the position of the lug 21 in the receptacle 43 which is formed by the wall section 20. As FIG. 7 also shows, the operating-mode selector 9 has a cover wall 34 which runs around the pivot axis 15 in the shape of an arc of a circle. The cover wall 34 covers an opening formed in the top handle 3. An actuating section 37 of the operating-mode selector 9 projects through the opening.

Figure 9:
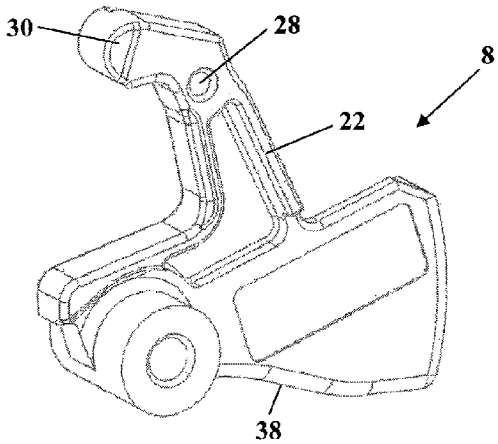
FIG. 9 shows a perspective view of the throttle trigger.
Figure 10:
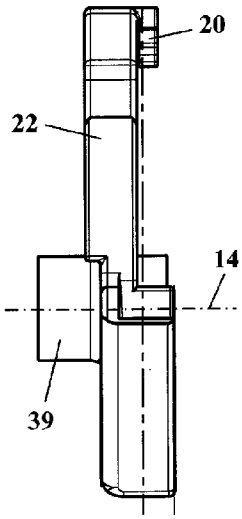
FIG. 10 shows a side view of the throttle trigger in the direction of the arrow X of FIG. 8.

As FIG. 8 shows, the throttle trigger 8 has an actuating section 38 which projects out of the top handle 3 and is to be actuated by the operator. A chamfer 29 is formed on the side of the wall section 20 which faces toward the pivot path 45 of the lug 21 in the non-actuated position 48. As FIG. 9 shows, a chamfer 30, which is described in more detail below, is arranged on the opposite side of the arm 22.

Figure 11:
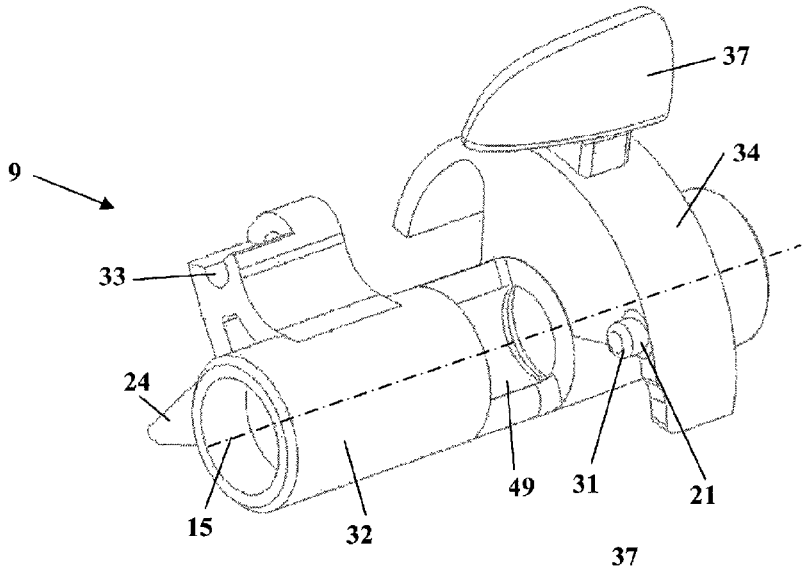
FIG. 11 and FIG. 12 show perspective views of the operating-mode selector; and, FIG. 13 shows a section through the operating-mode selector.
Figure 12:
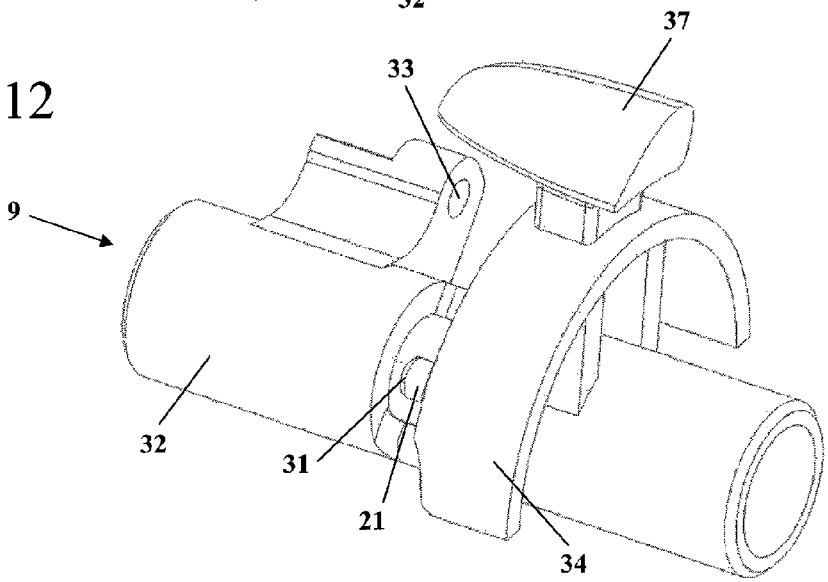
Figure 13:
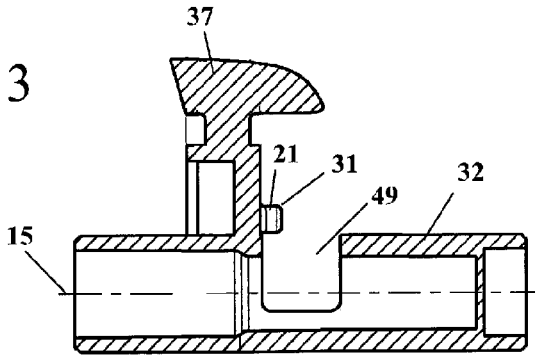

As FIGS. 11 and 12 show, a receptacle 33 for a contact pin is formed on the bearing shaft 32 of the operating-mode selector 9 in the axial direction of the pivot axis 15 adjacent to the actuating section 37. As the FIGS. 11 and 12 also show, the lug 21 has a radius 31 at its free end which enables the release of the starting position 41 through a lateral displacement of the wall section 20. If the operating-mode selector 9 is pushed from the starting position 41, shown in FIGS. 5 to 7, into the off position 42, then the radius 31 effects a lateral displacement of the arm 22 with the wall section 20. The radius 31 in this case slides on the wall section 20 and deflects the latter in the direction of the pivot axis 14 of the throttle trigger 8. Thus, a release of the latched position with corresponding force application is possible, so that the off position 42 can be set from the starting position 41 solely by actuating the operating-mode selector 9. Alternatively or additionally, an elastic deformation of the lug 21 and/or of the wall section 20 can be provided for the release of the latching. As a result of the fact that the wall section 20 and/or the lug 21 move in the axial direction of the pivot axis 14 and not in the peripheral direction towards the pivot axis 14, actuation of the throttle trigger 8, when the latching position is released, is avoided. Instead of by actuating the operating-mode selector 9, it is possible to release the starting position also in the typical manner by opening the throttle. In this case, the wall section 20 pivots out of the pivot path 45 of the lug 21 which releases the latching.

The bearing shaft 32 has a cutout 49 directly adjacent to the cover wall 34 on which the lug 21 is also arranged. The arm 22 of the throttle trigger 8 is introduced into the cutout 49 in the full throttle position shown in FIG. 4. In order to avoid interlocking of the throttle trigger 8 at the edge of the cutout 49 when the throttle is opened, chamfers 29 and 30 are provided on the throttle trigger 8. The chamfers 29 and 30 serve as lead-in chamfers when opening the throttle.

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:

a housing;

a handle configured to be arranged above said housing in a typical storage position of said work apparatus and said handle being configured as a carrying handle;

a throttle trigger having a starting position and a non-actuated position;

said throttle trigger being arranged on said handle;

a throttle trigger lock arranged on said handle;

an operating-mode selector having an off position, an operating position and at least one starting position;

said throttle trigger, said throttle trigger lock and said operating-mode selector being pivotally mounted;

a first latch element defining a first pivot path and being arranged on said operating-mode selector;

a second latch element arranged on said throttle trigger;

said first and second latch elements being configured to coact in said starting position of said operating-mode selector and said starting position of said throttle trigger so as to hold said throttle trigger in said starting position thereof; and, said second latch element being configured to lie outside of said first pivot path of said first latch element when said throttle trigger is in said non-actuated position.

2. The work apparatus of claim 1, wherein:

said throttle trigger has a full throttle position;

said second latch element is configured to pivot through said first pivot path of said first latch element when moving said throttle trigger from said non-actuated position to said full throttle position; and, said second latch element is configured to lie outside of said first pivot path of said first latch element when said throttle trigger is in the full throttle position.

3. The work apparatus of claim 1, wherein:

said second latch element defines a second pivot path; and, said first latch element is configured to lie in said second pivot path of said second latch element when said operating-mode selector is in said starting position of said operating-mode selector.

4. The work apparatus of claim 1, wherein:

said throttle trigger defines a first pivot axis;

said first latch element and said second latch element are configured to extend in the direction of said first pivot axis;

said first latch element and said second latch element are configured to be mutually latched when said operating-mode selector is in said starting position thereof and said throttle trigger is in said starting position thereof; and, said first latch element and said second latch element are configured so that the latching of said first and second latch elements is released when said operating-mode selector is moved from said starting position thereof into said off position thereof.

5. The work apparatus of claim 4, wherein one of said first and second latch elements is configured to move said other one of said latch elements in the direction of said first pivot axis of said throttle trigger when said latching is released.

6. The work apparatus of claim 4, wherein at least one of said first latch element and said second latch element is deformed when said latching is released.

7. The work apparatus of claim 4, wherein:

at least one of said first and second latch elements has a section which is inclined toward said first pivot axis of said throttle trigger;

said section is configured to slide off on the other one of said latch elements when said operating-mode selector is pivoted from said starting position into said off position.

8. The work apparatus of claim 7, wherein one of said first latch element and said second latch element is a lug.

9. The work apparatus of claim 8, wherein:

said lug has a free end; and, said section which is inclined towards said first pivot axis of said throttle trigger is arranged on said free end of said lug.

10. The work apparatus of claim 1, wherein at least one of said first latch element and said second latch element is an arch-shaped wall section which forms a receptacle for said other one of said latch elements.

11. The work apparatus of claim 10, wherein said arch-shaped wall section is arranged on an arm of said throttle trigger.

12. The work apparatus of claim 1, wherein said operating-mode selector has a receptacle for a contact pin.

13. The work apparatus of claim 1, wherein:

said throttle trigger defines a first pivot axis;

said throttle trigger lock defines a second pivot axis;

said operating-mode selector defines a third pivot axis;

said first pivot axis of said throttle trigger, said second pivot axis of said throttle trigger lock, and said third pivot axis of said operating-mode selector are mutually parallel;

said second pivot axis is at a distance (a) to said first pivot axis;

said first pivot axis is at a distance (b) to said third pivot axis; and, said second pivot axis is at a distance (c) to said third pivot axis.

14. The work apparatus of claim 1, further comprising:

an actuating element having a contact point and being configured for actuating a drive motor of said work tool and to engage on the throttle trigger;

said contact point of said actuating element having a distance (d) to said second latch element;

said throttle trigger defining a first pivot axis;

said contact point of said actuating element having a distance (e) to said first pivot axis of said throttle trigger; and, said distance (d) being up to a third as large as said distance (e).

* * * * *